US007446490B2

(12) United States Patent
Jongen et al.

(10) Patent No.: US 7,446,490 B2
(45) Date of Patent: Nov. 4, 2008

(54) CYCLOTRON

(75) Inventors: Yves Jongen, Louvain-La-Neuve (BE); Frédéric Genin, Louvain-La-Neuve (BE)

(73) Assignee: Ion Beam Appliances S.A. (BG)

( * ) Notice: Subject to any disclaimer, the term of this patent is extended or adjusted under 35 U.S.C. 154(b) by 403 days.

(21) Appl. No.: 10/536,333

(22) PCT Filed: Nov. 14, 2003

(86) PCT No.: PCT/BE03/00196

§ 371 (c)(1),
(2), (4) Date: Oct. 21, 2005

(87) PCT Pub. No.: WO2004/049770

PCT Pub. Date: Jun. 10, 2004

(65) Prior Publication Data

US 2006/0255285 A1 Nov. 16, 2006

(30) Foreign Application Priority Data

Nov. 25, 2002 (EP) ..... 02447230

(51) Int. Cl.
*H05H 13/00* (2006.01)

(52) U.S. Cl. ..... 315/502; 315/501; 315/506

(58) Field of Classification Search ..... 250/251; 315/502

See application file for complete search history.

(56) References Cited

U.S. PATENT DOCUMENTS 3,398,308 A 8/1968 Steimel (Continued)

FOREIGN PATENT DOCUMENTS

EP 1 069 809 A1 1/2001

(Continued)

OTHER PUBLICATIONS

Baartmen et al. "A 30 McV H Cyclotron for Isotope Production" TRIUMF and Ebco Industries Ltd. p. 1623-1625.

(Continued)

*Primary Examiner*—Jack I. Berman
*Assistant Examiner*—Andrew Smyth
(74) *Attorney, Agent, or Firm*—Fitch, Even, Tabin & Flannery

(57) ABSTRACT

The invention relates to a cyclotron which can produce a beam of accelerated charged particles that are intended for the irradiation of at least one target (200). The inventive cyclotron consists of a magnetic circuit which essentially comprises: an electromagnet with at least two poles (1, 1'), namely an upper pole (1) and a lower pole (1'), which are disposed symmetrically in relation to a mid-plane (110) which is perpendicular to the central axis (100) of the cyclotron and which are separated by a gap (120) containing the circulating charged particles and return flux (2) in order to close the aforementioned magnetic circuit; and a pair of main induction coils (5, 5') which are used to create an essentially-constant main induction field in the gap between poles 1 and 1'. The invention is characterised in that it comprises means of centring the above-mentioned beam, consisting of at least one pair of bucking coils (6, 7) which are supplied by an electrical source (8) and which can modulate the intensity of the main induction field produced by the main coils (5, 5'), in order to increase the intensity of the induction field in a first area of the cyclotron and to reduce the intensity of the induction field in a second area of the cyclotron, which is diametrically opposed to the central axis (100) of the cyclotron.

5 Claims, 4 Drawing Sheets

U.S. PATENT DOCUMENTS

| | | | | |
|---|---|---|---|---|
| 3,868,522 | A | 2/1975 | Bigham et al. | |
| 4,639,634 | A | 1/1987 | Meyrand | |
| 5,868,077 | A * | 2/1999 | Kuznetsov | 104/281 |

FOREIGN PATENT DOCUMENTS

| | | |
|---|---|---|
| FR | 1.395.308 | 3/1965 |

OTHER PUBLICATIONS

Song et al. "Characteristics of INER TR30/15 H/sup-//D/sup-/Compact Cyclotron" Nuclear Science Journal, Apr. 1994, Taiwan (Abstract).

* cited by examiner

CYCLOTRON

OBJECT OF THE INVENTION

The present invention relates to a cyclotron and a method that allows the position of a beam of charged particles to be easily and effectively adjusted.

TECHNOLOGICAL BACKGROUND AND PRIOR ART

Cyclotrons are circular accelerators allowing the acceleration of charged particles such as positive ions (protons, deuterons, helions, alpha particles, etc.) or negative ions (H", D–, etc.), which are utilized among others for producing radioactive isotopes, for radiation therapy, or for experimental purposes.

The first cyclotrons comprised a magnetic circuit that was simply comprised of two symmetrical poles disposed on both sides of a median plane and separated by a gap in which the accelerated particles circulate. The magnetic circuit is supplemented by flux returns in order to close said circuit and cylinder heads used as base plates at the poles. The poles are surrounded by a pair of induction coils supplied by a current, which generates a uniform and constant magnetic field that is capable of confining the particles according to an essentially circular trajectory or more precisely according to a trajectory in the form of a spiral in the median plane.

In an improved variation, azimuthal field variation machines are known. The poles of the electromagnet are then divided into sectors alternatively presenting a smaller gap and a larger gap. The azimuthal field variation that results has the effect of ensuring the vertical and horizontal focalization of the beam during acceleration.

Among the azimuthal field variation cyclotrons, one must distinguish between compact type cyclotrons, whose field is created by a pair of circular main coils, from cyclotrons with separate sectors, in which the magnetic structure is divided into entirely autonomous separate units, where each pair of poles disposes its own coils.

Document EP-A-0222786 describes an example of a compact isochronous cyclotron.

A large field of application for cyclotrons is the utilization of accelerated particles to bombard targets in order to produce radioisotopes. In this object, one may extract said accelerated particle beam from the cyclotron. Among the extraction methods, a known method is the method of extraction by "stripping." The accelerated particles are most often negatively charged ions comprised of a nucleus and several electrons.

In the vicinity of the periphery of the cyclotron, the beam is directed towards a thin sheet, called the "stripping sheet," generally made of carbon. This stripping sheet has the effect of stripping the peripheral electrons from the ions, thus changing their charge. The trajectory curve is thus inverted and the beam is directed to the outside of the machine, by an opening made in the flux return of the magnetic circuit.

Another known method of extraction of the beam is auto-extraction, by means of an abrupt radial variation in the induction field at the periphery of the cyclotron. This method is described in detail in documents WO A-97/14279 and WO-A-01/05199.

For the particular application of producing radioisotopes, the beam of charged particles is directed towards a target containing at least one precursor element of the radioisotope to be produced. In this case, it is particularly desirable that the beam be directed towards the center of the target.

An element limiting the productivity of the radioisotope production system is the capacity of the target to dissipate the thermal capacity that the target receives by the beam. If said target receives an intensity that is too strong from the beam (or current), it risks being damaged. For some types of targets, irradiation intensities are limited to 40 μA, while cyclotrons used in nuclear medicine are capable of producing beams with intensities that may reach 80 to 100 μA. Therefore, one may not fully utilize the production capacities of the cyclotron in this scenario, essentially due to the fact that one cannot manage to sufficiently cool the target.

In the object of increasing the productivity of a system for producing radioisotopes while not exceeding the limit of acceptable current for a target, double beam systems have been proposed. According to such a configuration, two stripping sheets are disposed at the periphery of the cyclotron in a diametrically opposed manner with relation to the central axis of the machine. The beam is thus divided into two roughly equal fractions. Nevertheless, owing to, for example, a defect in the symmetry of the cyclotron, it could be that one of the targets receives a beam intensity that is essentially different from that received by the other target. Then it may happen that one of the targets could be damaged by a current that is too strong. This situation could be produced in particular when, in the course of a lengthy irradiation, for example of several hours, some machine settings thus undergo a drift, particularly following a progressive heating of its elements.

To resolve this problem, proposing stripping sheets that are radially displaceable is known. This solution is used for example in the Cyclone 30 machine of the Applicant. By a radial displacement of the stripping sheet towards the inside or outside of the cyclotron, one increases or reduces the fraction of the beam intercepted by the sheet. In a double beam machine, one may, by displacing one of the two sheets towards the inside and the other sheet towards the outside, ensure the balanced distribution of the intensity of the beam hitting each of the targets. However, this solution is delicate and costly, since it requires the installation of adjustable mobile equipment within the same machine, that is, in the vacuum chamber.

The utilization of harmonic coils has also been proposed in order to make the two beams of particles issued from the same double beam system essentially equivalent, that is, presenting an equivalent intensity. According to this solution, disposing small-size harmonic coils between the poles of the electromagnet has been proposed. Opposite currents flow through two coils, which produces an increase in the magnetic field in a region of the gap, and a reduction in the magnetic field in the region of the diametrically opposed gap. This solution thus allows the intensity of the beams to be adjusted, but presents the following disadvantages: in particular, the harmonic coils must be located at the hills, where the gap is the narrowest. Thus, the coils may be directly reached by the beam, more particularly in the case of a defect in the axial alignment of said beam, which will inevitably lead to the destruction of said coils. Furthermore, as these coils are disposed in the vacuum chamber, the conductors powering these coils must traverse the wall of said chamber by means that respect a complete leakproofness, which may pose difficulties.

A third solution that is known and already utilized by the applicant is illustrated in FIG. 1. If one causes the high-frequency alternating current voltage applied to the acceleration electrodes (the dees) to be varied, one observes the following situation: if the amplitude of the high-frequency voltage applied to the dees (Vdee) is progressively increased, a corresponding increase in the total intensity of the beam produced by the cyclotron is observed, which is explained by the increase in effectiveness of the ion supply with this voltage. One also observes, as is shown in FIG. 1, that the intensities reaching each of the targets fluctuate around an average value, and that for some specified Vdee values, where the curves intersect, the intensities are equal. Thus it suffices to choose the Vdee voltage that is equal to one of these values to equalize the intensity of the beam reaching each of the targets. However, cases where these two curves never intersect have been observed following thermal drift, or due to dissymmetries in the construction of the cyclotron. It is then impossible to equalize the currents hitting the two targets by this method.

OBJECTS OF THE INVENTION

The present invention aims to propose a device and method that do not present the disadvantages of the devices and methods of the prior art described above.

An important object of the invention is to propose a device and method allowing the intensity of the beam of charged accelerated particles extracted from a cyclotron to be adjusted on said target, in such a way as to obtain the desired technical effect (for example, the production of a radioelement of interest from a precursor element contained in said target) at said target and without destroying the target, but while fully utilizing the production capacities of the cyclotron.

The present invention particularly aims to propose a device and method that may be utilized in a irradiation system, and in particular a system with a compact isochronous cyclotron, in which the simultaneous irradiation of at least two targets is desired; that is, double or multiple beams for one irradiation system.

The present invention thus aims to propose in particular a device and method that try to adjust and regulate the intensity of each of the beams received by several targets simultaneously.

Characteristic Elements of the Invention

The present invention relates to a cyclotron that is capable of producing a beam of accelerated charged particles intended for the irradiation of at least one target, said cyclotron comprising a magnetic circuit that essentially comprises:

an electromagnet with at least two poles, an upper pole and a lower pole, said poles being disposed symmetrically with relation to a median plane that is perpendicular to the central axis of the cyclotron, and separated by a gap containing the circulating charged particles and flux return in order to close said magnetic circuit;

a pair of main induction coils for creating an essentially-constant main induction field in the gap between said poles, characterized in that the invention comprises means for centering said beam comprising at least one pair of bucking coils powered by a power supply and capable of modulating the intensity of the main induction field produced by said main coils in order to obtain an increase in the intensity of the induction field in a first area of the cyclotron and a reduction in the intensity of the induction field in a second area of the cyclotron that is diametrically opposed with relation to the central axis of the cyclotron.

Preferably, said bucking coils surround portions of the flux return disposed in a diametrically opposed manner with relation to the central axis of the cyclotron.

The present invention also relates to a method for centering a beam extracted from a cyclotron on a target, said cyclotron comprising a magnetic circuit that is essentially comprised of:

an electromagnet with at least two poles, an upper pole and a lower pole, said poles being disposed symmetrically with relation to a median plane perpendicular to the central axis of the cyclotron and separated by a gap where the charged particles and flux return circulate to close said magnetic circuit;

a pair of main induction coils for creating an essentially constant main induction field in the gap, between said poles.

Said method is characterized by the following succession of steps:

the cyclotron is equipped with at least one pair of bucking coils disposed in such a way as to surround diametrically opposed portions of the flux return with relation to the central axis of the cyclotron;

the pair of main coils is powered in such a way as to create an essentially constant magnetic field in the gap of the cyclotron, the bucking coils are powered through a power supply in such a way as to increase the intensity of the induction field in a first area of the cyclotron and to reduce the intensity of the induction field in a second area situated in diametric opposition with relation to the central axis of the cyclotron.

Preferably, in said method, the intensity of the current from the power supply is regulated or adjusted in order to maximize the intensity of the beam hitting the target.

Advantageously, in said method:

the intensity of the beam current is measured at said target by using a detector, this measurement is transmitted to a regulator, and according to this measurement, the intensity of the current in the bucking coils is regulated or adjusted through an adjustment of the supply current.

The present invention also relates to the utilization of the method and the device for producing radioisotopes for medical uses from a target comprising a precursor of said radioisotope.

Advantageously, the method and device are utilized for a double or multiple beam system according to which the intensity of the fraction of the beam hitting each of said targets is balanced.

DETAILED DESCRIPTION OF A PARTICULAR EMBODIMENT OF THE INVENTION

Figure 1:
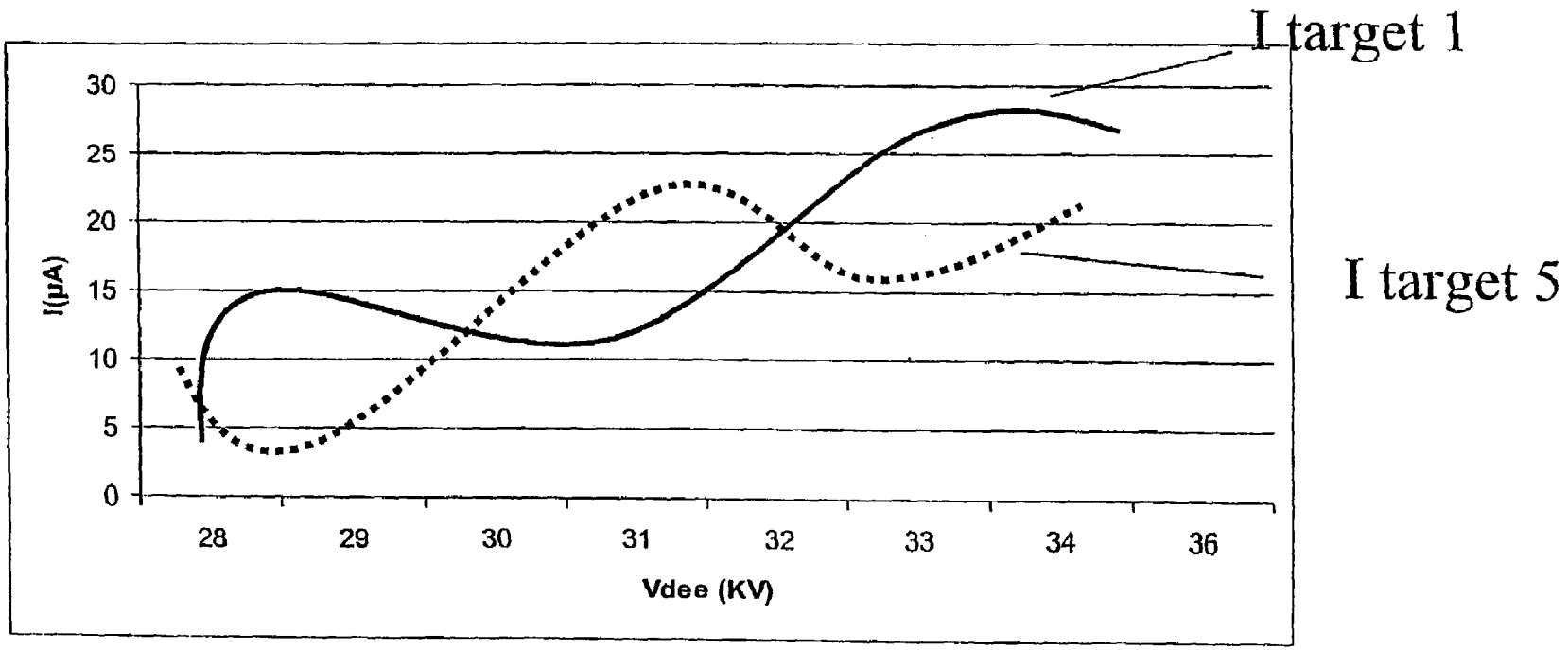
FIG. 1 represents the intensity of the beam hitting each of the two targets of a double beam cyclotron, according to the high-frequency alternating current voltage applied to the dees.
Figure 2:
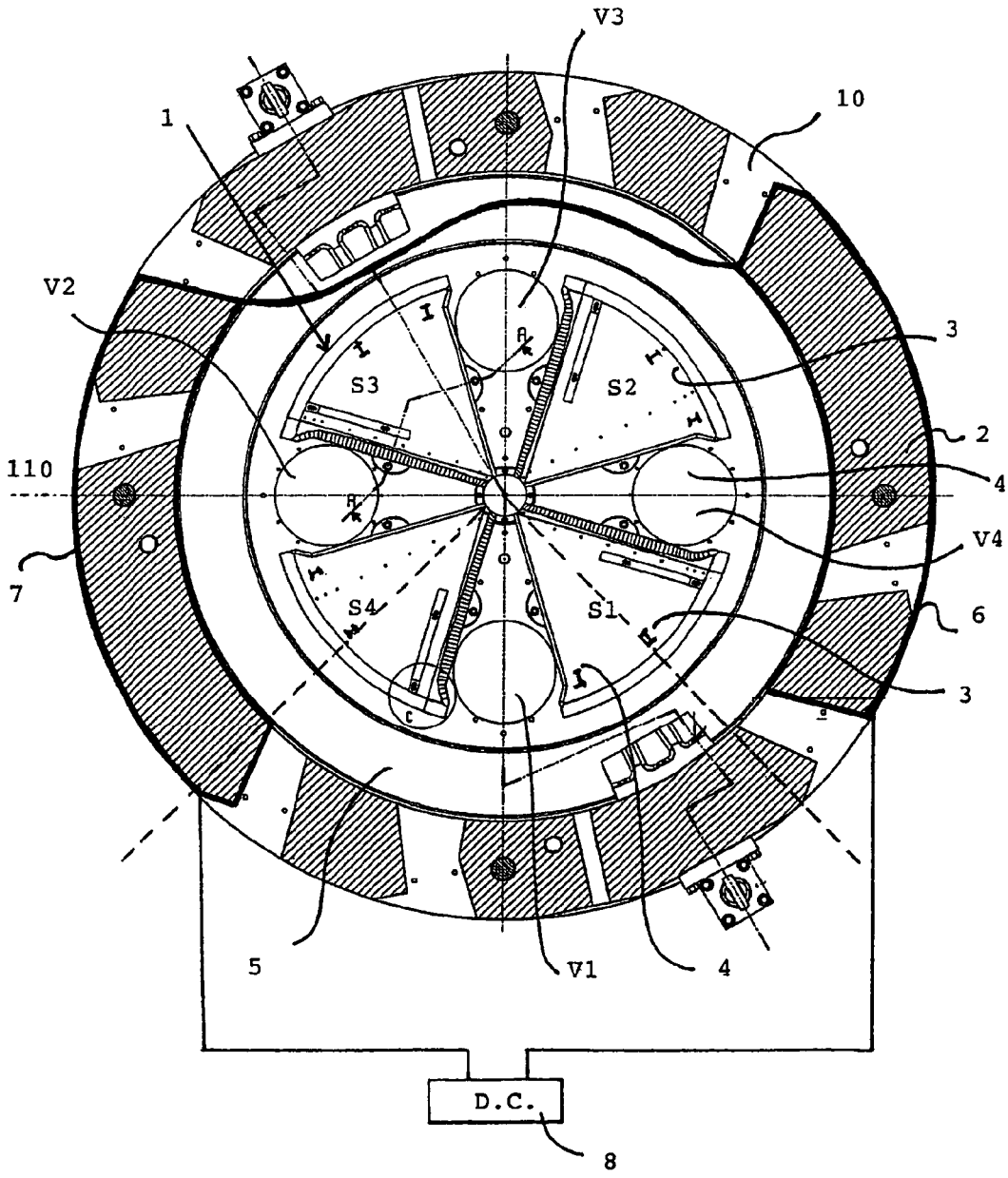
FIG. 2 represents a view of a cyclotron according to the invention corresponding to a top view according to a section in the median plane of the cyclotron.
Figure 3:
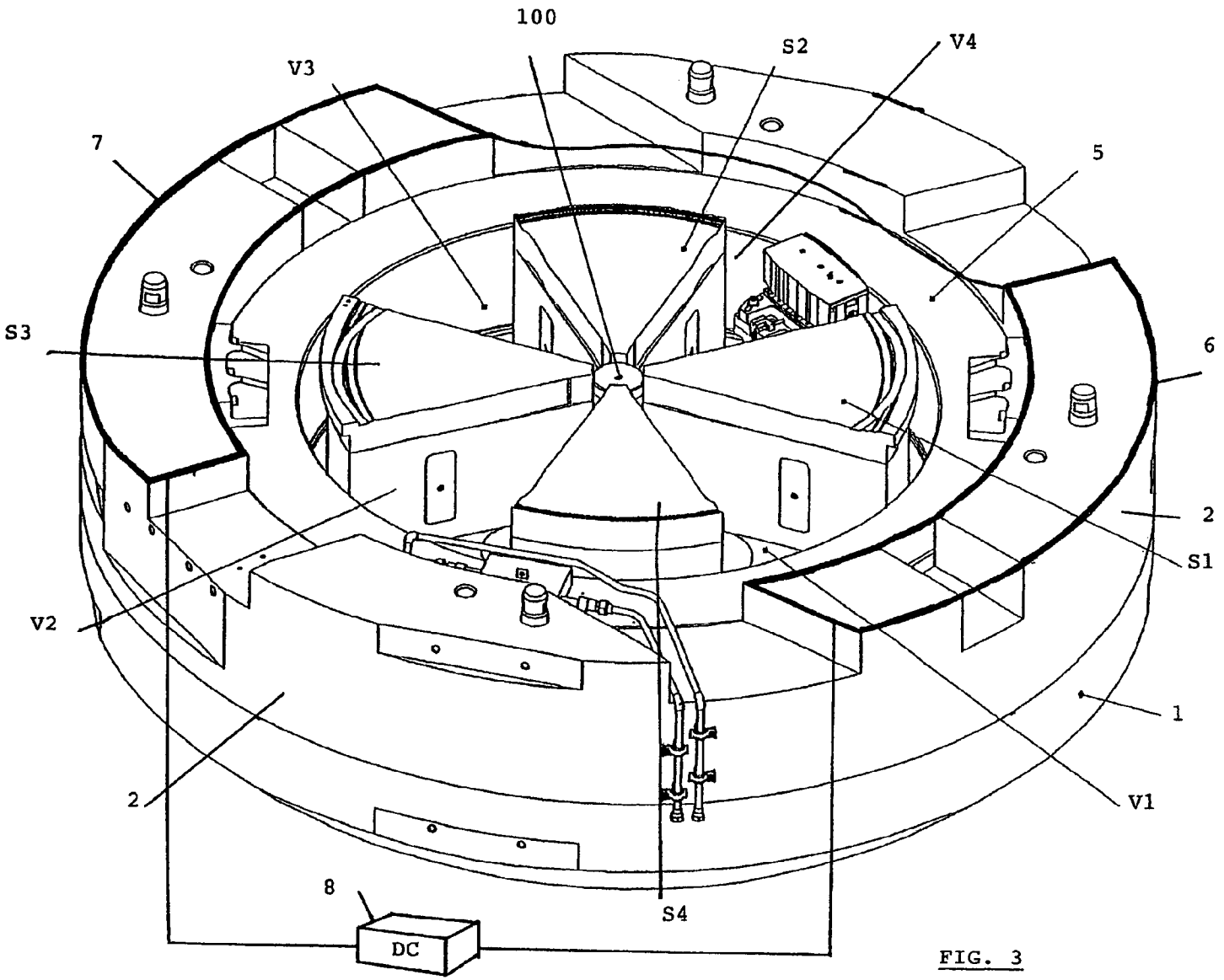
FIG. 3 represents a view of the cyclotron of FIG. 2, a complementary perspective view of the view of FIG. 2.
Figure 4:
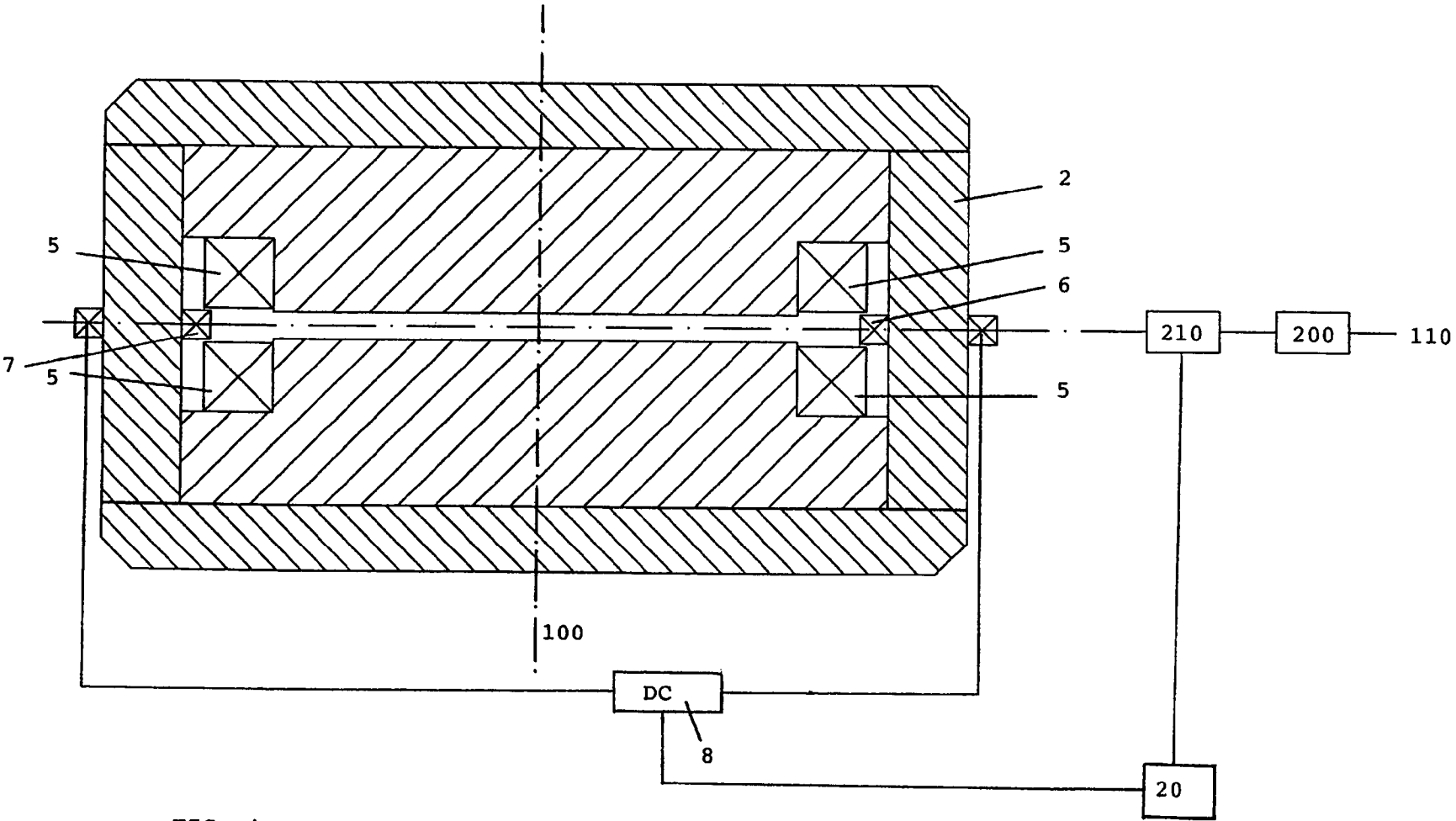
FIG. 4 represents a diagram of a control loop implementing the method according to the present invention.

FIGS. 2, 3 and 4 show a compact isochronous cyclotron utilized in the framework of a preferred embodiment of the present invention. This cyclotron conventionally comprises several subsystems:

a. a magnetic circuit, b. an RF acceleration device, c. a vacuum chamber d. charged particle injection means, e. accelerated charged particle extraction means.

The magnetic circuit is essentially comprised of an electromagnet presented in the form of two poles, an upper pole 1 (not represented in FIGS. 2 and 3) and a lower pole 1', symmetrically disposed with relation to a median plane 110 perpendicular to the central axis 100 of the cyclotron. These poles 1, 1' essentially have a cylindrical form and are separated by a gap 120.

In addition, the magnetic circuit is completed by flux returns 2 that close the circuit.

According to the particular embodiment represented in the figures, the two upper 1 and lower 1' poles of the electromagnet each comprise (are divided into) several sectors in order to alternately create hills, that is, sectors where the gap is narrow, marked by references S1, S2, S3, S4, and valleys, that is, sectors where the gap is large, marked by references V1, V2, V3, V4.

Advantageously, openings 10 are located in the flux return 2. These openings 10 may advantageously let one or more beam lines through, or house one or more targets in their volume that may be used simultaneously or separately.

Furthermore, a pair of solenoid coils 5, 5' is wound around said poles 1, 1'. Said pair of coils 5, 5' is called "pair of main induction coils" and is capable of generating a constant magnetic field called the "main magnetic field."

According to the invention, the cyclotron also comprises two additional coils, called "centering coils" or "bucking coils" 6, 7. These coils 6, 7 surround portions of the flux return 2 and are disposed in a diametrically opposed manner with relation to the central axis 100. These coils, which are wired in series, are powered with direct current by a D.C. type supply 8 whose intensity is adjustable. Each bucking coil 6, 7 is thus capable of locally modifying the magnetic field.

More precisely, these two bucking coils 6, 7 are put together in such a way that, in its vicinity, one of these coils 6 increases the main field created by the main coils 5, 5' while the other coil 7 reduces, in its vicinity, the main field created by the main coils 5, 5'.

In other words, according to the invention, thanks to the use of bucking coils 6, 7, an increase in the magnetic induction field resulting at area A situated at sectors S1 and S2 is locally obtained. At the same time, a reduction in the magnetic induction field resulting at area B situated at sectors S3 and S4 is obtained. However for all that, the average field exerting on a particle in the course of a revolution in the machine, defined as the average of the induction fields created on the entire path of a charged particle, remains roughly unchanged.

The increase in intensity of the field resulting in the neighboring sectors S1 and S2 (area A) has the effect of reducing the radius of curvature of the trajectories of particles in these sectors. Inversely, the reduction in the field in the opposite sectors S3 and S4 (area B) has the effect of increasing the radius of curvature of the trajectories of particles. A displacement of the particle trajectories results. The trajectories remain roughly circular, but are no longer centered on the central axis of the cyclotron, but are slightly off-center towards the bottom of FIG. 2.

In addition, one will notice that although supplementary openings may be made in the flux returns 2 to allow turns of the bucking coils 6, 7 to pass through, it is possible and easy to allow them to pass through existing openings 10 provided for the installation of targets.

Furthermore, the cyclotron comprises stripping sheets (or strippers) 3, 4 as extraction means. Advantageously, these sheets are constructed of carbon and have the function of stripping the peripheral electrons from the ions, thus changing their charge. In this case, the curvature of the trajectory of said ions is thus reversed and the particle beam is directed to the outside of the cyclotron by an opening made in the flux return element of the magnetic circuit. The first sheet 3 is disposed on the bisector S of the pole, the second sheet 4 at 11° upstream of the first. Each of these strippers 3, 4 may be activated or withdrawn by means of a motorized device.

The displacement of the trajectories of accelerated particles would have the effect of first increasing the fraction of the beam hitting the strippers situated at sectors S1 and S4, and secondly reducing the fraction of the beam hitting the strippers situated at sectors S2 and S3. By reversing the direction of the current in the bucking coils 6, 7, one would of course obtain the reverse effect, that is, an increase in the fraction of the beam hitting the strippers situated at sectors S2 and S3, and a reduction in the fraction of the beam hitting the strippers situated at sectors S1 and S4.

The applicant has experimented with a practical solution according to which the bucking coils 6, 7 each comprise 60 turns powered by a direct current supply 8 capable of providing an intensity of 20 A, which is suitable for adjusting an industrial cyclotron.

FIG. 4 describes in detail a diagram representing a control loop of a cyclotron implementing the method according to the present invention. In this figure, one provides a conventional regulator 20 of a known type that may adjust the intensity of the current in the bucking coils 6, 7 through variation in the supply current from supply 8 according to the intensities of the beam measured by the detectors 210 at the targets 200.

By adjusting the intensity of the current provided by the supply 8 traversing the bucking coils 6, 7, one thus adjusts the intensity of the current of the beam hitting each of the targets 200 in a fine and flexible manner. A current in the opposite direction may be injected by the supply 8 in the bucking coils 6, 7 if a correction in the opposite direction is necessary. Thus, the total intensity hitting the target(s) is maximized. In the case of a double beam system, one may thus adjust the current of the bucking coils although each of the targets receives the same beam intensity.

In conclusion, the device according to the invention is particularly simple to implement. It may be easily installed on an existing machine, without major intervention on the magnetic circuit, and without intervention inside the vacuum chamber, which constitutes an advantage with relation to, for example, the utilization of harmonic coils placed in the gap of hills such as described in the prior art.

It will be noted that the invention should not be understood as being limited to the example of embodiment described previously, but applies to other variations and applications. In particular, the invention is not limited to an application for double beam systems, but may be applied to single or multiple, for example quadruple, beam systems. The invention is also applied to the usage of more than two centering coils, for example four centering coils, disposed at 90° , and makes it possible to center the beam in all directions or change the form of the trajectories. It may be applied to a superconducting cyclotron or to a resistive cyclotron.

The invention claimed is:

1. A cyclotron capable of producing a beam of accelerated charged particles intended for the irradiation of at least one target, said cyclotron comprising a magnetic circuit that is essentially comprised of:

an electromagnet with at least two poles, an upper pole and a lower pole, said poles being disposed symmetrically with relation to a median plane that is perpendicular to the central axis of the cyclotron, and separated by a gap where charged particles and flux returns circulate to close said magnetic circuit;

a pair of main induction coils for creating an essentially constant main induction field in the gap, between said poles, characterized in that it comprises means for centering said beam comprising at least one pair of bucking coils powered by a power supply and capable of modulating the intensity of the main induction field by said main coils in order to obtain an increase in the intensity of the induction field in a first area of the cyclotron and a reduction in intensity of the induction field in a second area of the cyclotron that is diametrically opposed with relation to the central axis of the cyclotron.

2. The cyclotron according to claim 1, wherein the bucking coils surround portions of the flux return disposed in diametric opposition with relation to the central axis of the cyclotron.

3. A method for centering a beam extracted from a cyclotron on a target, the method comprising:

providing a cyclotron comprising a magnetic circuit essentially comprised of an electromagnet with at least two, an upper pole and a lower pole, said poles being symmetrically disposed with relation to a median plane that is perpendicular to the central axis of the cyclotron and separated by a gap where the charged particles and flux returns circulate to close said magnetic circuit; a pair of man induction coils for creating an essentially constant main induction field in the gap between said poles wherein: the cyclotron is equipped with at least one pair of bucking coils disposed in such a way as to surround the diametrically opposed portions of the flux return with relation to the central axis of the cyclotron;

powering the pair of main coils in such a way as to create an essentially constant magnetic field in the gap of the cyclotron, and powering the bucking coils through a power supply in such a way as to increase the intensity of the induction field in a first area of the cyclotron and to reduce the intensity of the induction field in a second area situated in diametric opposition with relation to the central axis of the cyclotron.

4. The method according to claim 3, wherein the intensity of the current of the power supply is regulated or adjusted in order to maximize the intensity of the beam hitting a target.

5. The method according to claim 4, wherein: the intensity of the current of the beam is measured at said target by using a detector, this measurement is transmitted to a regulator, and according to this measurement, the intensity of the current in the bucking coils is regulated or adjusted through an adjustment in the supply current.

* * * * *